US009903352B2

(12) United States Patent
Nakaima et al.

(10) Patent No.: US 9,903,352 B2
(45) Date of Patent: Feb. 27, 2018

(54) SWASH PLATE TYPE VARIABLE DISPLACEMENT COMPRESSOR

(71) Applicant: KABUSHIKI KAISHA TOYOTA JIDOSHOKKI, Aichi (JP)

(72) Inventors: Hiroyuki Nakaima, Kariya (JP); Shinya Yamamoto, Kariya (JP); Takahiro Suzuki, Kariya (JP); Masaki Ota, Kariya (JP); Kazunari Honda, Kariya (JP); Kei Nishii, Kariya (JP); Yusuke Yamazaki, Kariya (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 269 days.

(21) Appl. No.: 14/439,498

(22) PCT Filed: Nov. 1, 2013

(86) PCT No.: PCT/JP2013/079679
§ 371 (c)(1),
(2) Date: Apr. 29, 2015

(87) PCT Pub. No.: WO2014/069618
PCT Pub. Date: May 8, 2014

(65) Prior Publication Data

US 2015/0285234 A1 Oct. 8, 2015

(30) Foreign Application Priority Data

Nov. 5, 2012 (JP) ..... 2012-243986
Oct. 4, 2013 (JP) ..... 2013-208902

(51) Int. Cl.
*F04B 27/18* (2006.01)
*F04B 27/10* (2006.01)
(Continued)

(52) U.S. Cl.
CPC ..... *F04B 27/18* (2013.01); *F04B 27/1054* (2013.01); *F04B 27/12* (2013.01);
(Continued)

(58) Field of Classification Search
CPC ..... F04B 27/18; F04B 27/12; F04B 27/14; F04B 27/16; F04B 27/1054;
(Continued)

(56) References Cited

U.S. PATENT DOCUMENTS 3,062,020 A 11/1962 Heidorn
4,037,993 A * 7/1977 Roberts ..... F04B 27/1804 417/222.2
(Continued)

FOREIGN PATENT DOCUMENTS

CN 1075778 9/1993
CN 1225422 8/1999
(Continued)

OTHER PUBLICATIONS

English translation of International Preliminary Report on Patentability in PCT/JP2013/079679, report dated May 5, 2015.
(Continued)

*Primary Examiner* — Alexander Comley
(74) *Attorney, Agent, or Firm* — Greenblum & Bernstein, P.L.C.

(57) ABSTRACT

A swash plate type variable displacement compressor includes a housing in which a suction chamber, a discharge chamber, a swash plate chamber, and a cylinder bore are formed, a drive shaft, a swash plate, an actuator, and a control mechanism that controls the actuator. A pressure regulation chamber is formed in the housing. The actuator includes a control pressure chamber. The control mechanism includes a control passage that connects together the discharge chamber, the pressure regulation chamber, and the
(Continued)

control pressure chamber, and a control valve that, by adjusting the degree of opening of the control passage, changes the pressure in the control pressure chamber to allow the movable body to move. Refrigerant in the discharge chamber flows into the control pressure chamber via the pressure regulation chamber. The pressure regulation chamber functions as a muffler that reduces the pulsation of the refrigerant.

8 Claims, 6 Drawing Sheets

(51) Int. Cl.
*F04B 27/12* (2006.01)
*F04B 11/00* (2006.01)

(52) U.S. Cl.
CPC ... *F04B 11/0091* (2013.01); *F04B 2027/1818* (2013.01); *F04B 2027/1831* (2013.01)

(58) Field of Classification Search
CPC ..... F04B 27/1072; F04B 27/1831; F04B 27/1859; F04B 49/123; F04B 1/295
USPC ..... 417/222.1, 222.2, 269, 270, 271
See application file for complete search history.

(56) References Cited

U.S. PATENT DOCUMENTS

| | | | | |
|---|---|---|---|---|
| 4,061,443 | A | 12/1977 | Black et al. | |
| 4,145,163 | A * | 3/1979 | Fogelberg | F04B 27/1063 417/222.1 |
| 4,174,191 | A * | 11/1979 | Roberts | F04B 27/18 417/222.1 |
| 4,886,423 | A | 12/1989 | Iwanami et al. | |
| 4,932,843 | A | 6/1990 | Itoigawa et al. | |
| 4,963,074 | A * | 10/1990 | Sanuki | F04B 27/18 417/222.1 |
| 5,002,466 | A | 3/1991 | Inagaki et al. | |
| 5,022,826 | A * | 6/1991 | Matsuda | F04B 27/12 417/222.1 |
| 5,032,060 | A * | 7/1991 | Kobayashi | F04B 27/12 417/222.1 |
| 5,259,736 | A * | 11/1993 | Terauchi | F01B 3/106 417/222.1 |
| 5,370,503 | A * | 12/1994 | Terauchi | F04B 27/1072 417/222.2 |
| 5,547,346 | A | 8/1996 | Kanzaki et al. | |
| 5,882,180 | A | 3/1999 | Kawaguchi et al. | |
| 6,142,745 | A * | 11/2000 | Kawaguchi | F04B 27/1804 417/222.2 |
| 6,164,929 | A * | 12/2000 | Kazuya | F04B 27/0895 417/222.2 |
| 6,217,293 | B1 | 4/2001 | Murase et al. | |
| 6,517,321 | B1 | 2/2003 | Takenaka et al. | |
| 6,742,439 | B2 | 6/2004 | Matsuda et al. | |
| 6,957,604 | B1 * | 10/2005 | Tiedemann | F04B 1/295 417/222.1 |
| 2002/0073722 | A1 | 6/2002 | Ota et al. | |
| 2002/0127116 | A1 | 9/2002 | Koelzer et al. | |
| 2006/0120882 | A1 | 6/2006 | Jordan et al. | |
| 2008/0145239 | A1 | 6/2008 | Murase et al. | |
| 2009/0064855 | A1 * | 3/2009 | Kayukawa | F04B 27/1072 92/12.2 |
| 2012/0073430 | A1 | 3/2012 | Uchikado | |
| 2012/0251344 | A1 | 10/2012 | Kobayashi et al. | |
| 2014/0127042 | A1 | 5/2014 | Yamamoto et al. | |
| 2014/0127045 | A1 | 5/2014 | Yamamoto et al. | |

FOREIGN PATENT DOCUMENTS

| | | |
|---|---|---|
| CN | 1461384 | 12/2003 |
| CN | 2787875 | 6/2006 |
| CN | 101387278 | 3/2009 |
| DE | 10 2009 006 909 | 8/2010 |
| EP | 1 906 017 | 4/2008 |
| EP | 1 933 031 | 6/2008 |
| JP | 52-131204 | 11/1977 |
| JP | 53-69911 | 6/1978 |
| JP | 58-162780 | 9/1983 |
| JP | 62-225782 | 10/1987 |
| JP | 64-41680 | 2/1989 |
| JP | 1-147171 | 6/1989 |
| JP | 2-16374 | 1/1990 |
| JP | 2-19665 | 1/1990 |
| JP | 2-132876 | 11/1990 |
| JP | 3-10082 | 1/1991 |
| JP | 3-134268 | 6/1991 |
| JP | 4-54287 | 2/1992 |
| JP | 5-18355 | 1/1993 |
| JP | 5-172052 | 7/1993 |
| JP | 5-312144 | 11/1993 |
| JP | 2002-21722 | 1/2002 |
| JP | 2002-349431 | 12/2002 |
| JP | 2003-206856 | 7/2003 |
| JP | 2004-60473 | 2/2004 |
| JP | 2007-239722 | 9/2007 |
| JP | 2010-281289 | 12/2010 |
| JP | 2011-27013 | 2/2011 |
| KR | 2010-0013736 | 2/2010 |
| WO | 2006/023923 | 3/2006 |

OTHER PUBLICATIONS

China Official Action and English translation thereof, dated Jul. 31, 2015.
China Official Action in Application No. 201310524846.0 and English translation thereof, dated Aug. 5, 2015.
China Official Action in Application No. 201310525972.8 and English translation thereof, dated Aug. 5, 2015.
China Official Action in Application No. 201310524675.1 and English translation thereof, dated Sep. 25, 2015.
U. S. Official Action (Notice of Allowance) received in U.S. Appl. No. 14/064,424, dated Aug. 26, 2015.
U.S. Official Action (Notice of Allowance) received in U.S. Appl. No. 14/064,499, dated Aug. 28, 2015.
U.S. Official Action received in U.S. Appl. No. 14/064,632, dated Sep. 2, 2015.
U.S. Official Action received in U.S. Appl. No. 14/064,733, dated Sep. 4, 2015.
U.S. Official Action received in U.S. Appl. No. 14/064,864, dated Sep. 4, 2015.
Search report from PCT/JP2013/079679, dated Feb. 10, 2014.
U.S. Appl. No. 14/064,864 to Shinya Yamamoto et al., filed Oct. 28, 2013.
U.S. Appl. No. 14/064,632 to Shinya Yamamoto et al., filed Oct. 28, 2013.
U.S. Appl. No. 14/064,733 to Shinya Yamamoto et al., filed Oct. 28, 2013.
U.S. Appl. No. 14/064,499 to Shinya Yamamoto et al., filed Oct. 28, 2013.
U.S. Appl. No. 14/064,424 to Shinya Yamamoto et al., filed Oct. 28, 2013.
Office Action issued in U.S.A. Counterpart U.S. Appl. No. 14/064,733, dated Sep. 4, 2015.
European Search Report received in Application No. 13851030.0, dated Nov. 13, 2015.

* cited by examiner

SWASH PLATE TYPE VARIABLE DISPLACEMENT COMPRESSOR

FIELD OF THE INVENTION

The present invention relates to a swash plate type variable displacement compressor.

BACKGROUND OF THE INVENTION

Patent Document 1 discloses a conventional swash plate type variable displacement compressor (hereinafter referred to as a compressor). This compressor includes a front housing member, a cylinder block, and a rear housing member, which form a housing. The front housing member and the rear housing member each include a suction chamber and a discharge chamber. The rear housing member also includes a control pressure chamber.

The cylinder block includes a swash plate chamber, a plurality of cylinder bores, and a main shaft through hole. Each cylinder bore includes a first cylinder bore formed in the rear part of the cylinder block and a second cylinder bore formed in the front part of the cylinder block. The main shaft through hole is formed in the rear part of the cylinder block and communicates with the swash plate chamber and the control pressure chamber.

The drive shaft is inserted in the housing and is rotationally supported in the cylinder block. The swash plate chamber accommodates a swash plate, which is rotatable through rotation of the drive shaft. A link mechanism, which allows change of the inclination angle of the swash plate, is arranged between the drive shaft and the swash plate. The inclination angle is defined as the angle of the swash plate with respect to a direction perpendicular to the rotation axis of the drive shaft.

Each cylinder bore reciprocally accommodates a piston. More specifically, each piston includes a first piston head that reciprocates in the first cylinder bore and a second piston head that reciprocates in the second cylinder bore. Thus, the first cylinder bore and the first piston head form a first compression chamber, and the second cylinder bore and the second piston head form a second compression chamber. A conversion mechanism reciprocates each of the pistons in the associated one of the cylinder bores by the stroke corresponding to the inclination angle through rotation of the swash plate. An actuator is capable of changing the inclination angle and controlled by a control mechanism.

The actuator is arranged in the swash plate chamber closer to the first cylinder bores relative to the swash plate. The actuator includes a non-rotational movable body, a movable body, a thrust bearing, and the control pressure chamber. The non-rotational movable body is arranged in the main shaft through hole not to rotate integrally with the drive shaft and covers the rear end of the drive shaft. The inner circumferential surface of the non-rotational movable body rotationally and slidably supports the rear end of the drive shaft. The outer circumferential surface of the non-rotational movable body slides in the main shaft through hole along the rotation axis so that the non-rotational movable body moves in the main shaft through hole in the front-rear direction. However, the non-rotational movable body does not slide about the rotation axis of the non-rotational movable body. The movable body is coupled to the swash plate and is movable along the rotation axis. The thrust bearing is located between the non-rotational movable body and the movable body.

Since the non-rotational movable body is arranged in the main shaft through hole, the main shaft through hole is partitioned into a rear end portion that communicates with the control pressure chamber and a front end portion that does not communicate with the control pressure chamber. The rear end portion of the main shaft through hole communicates with the control pressure chamber and functions as part of the control pressure chamber. The rear end portion has a pressing spring, which urges the non-rotational movable body forward.

The control mechanism includes a control passage and a control valve provided in the control passage. The control passage connects the control pressure chamber to the discharge chamber. The control valve adjusts the opening degree of the control passage to change the pressure in the control pressure chamber so that the non-rotational movable body and the movable body are movable along the rotation axis.

The link mechanism has a movable body and a lug arm fixed to the drive shaft. A rear end portion of the lug arm has an elongated hole, which extends in a direction perpendicular to the rotation axis of the drive shaft from the radially outer side toward the rotation axis. A pin is received in the elongated hole and supports the swash plate at a position forward to the swash plate such that the swash plate is allowed to pivot about a first pivot axis. A front end portion of the movable body also has an elongated hole, which extends in the direction perpendicular to the rotation axis of the drive shaft from the radially outer side toward the rotation axis. A pin is passed through the elongated hole and supports the swash plate at the rear end of the swash plate such that the swash plate is allowed to pivot about a second pivot axis, which is parallel to the first pivot axis.

The control valve of this compressor is capable of controlling the pressure in the control pressure chamber by the pressure of discharge refrigerant in the discharge chamber through adjustment of the opening degree of the control passage. Thus, the actuator of this compressor changes the inclination angle of the swash plate to allow change in the displacement per rotation of the drive shaft.

PRIOR ART DOCUMENTS

Patent Documents

Patent Document 1: Japanese Laid-Open Patent Publication No. 5-172052

SUMMARY OF THE INVENTION

In the above-mentioned conventional compressor, when the inclination angle of the swash plate is changed, the discharge refrigerant directly flows into the control pressure chamber through the control mechanism. Thus, the actuator of this compressor is susceptible to pulsation of the discharge refrigerant. This makes the inclination angle unstable and makes the compressor hard to operate at a suitable displacement in accordance with the operating condition of, for example, a vehicle to which the compressor is mounted.

Accordingly, it is an objective of the present invention to provide a swash plate type variable displacement compressor that is capable of operating at a suitable displacement.

To achieve the foregoing objective and in accordance with one aspect of the present invention, a swash plate type variable displacement compressor is provided that includes a housing in which a suction chamber, a discharge chamber, a swash plate chamber, and a cylinder bore are formed, a drive shaft that is rotationally supported by the housing, a swash plate that is rotational in the swash plate chamber by rotation of the drive shaft, a link mechanism, a piston reciprocally received in the cylinder bore, a conversion mechanism, an actuator, and a control mechanism that controls the actuator. The link mechanism is arranged between the drive shaft and the swash plate and allows change of an inclination angle of the swash plate with respect to a direction perpendicular to a rotation axis of the drive shaft. The conversion mechanism causes the piston to reciprocate in the cylinder bore by a stroke corresponding to the inclination angle of the swash plate through rotation of the swash plate. The actuator changes the inclination angle of the swash plate. The control mechanism controls the actuator. The housing has a pressure regulation chamber. The actuator includes a fixed body that is located in the swash plate chamber and fixed to the drive shaft, a movable body that is provided on the drive shaft and is capable of changing the inclination angle of the swash plate by moving along the rotation axis of the drive shaft, and a control pressure chamber defined by the fixed body and the movable body. The control pressure chamber changes the volume of the control pressure chamber by the pressure of refrigerant in the discharge chamber to move the movable body. The control mechanism includes a control passage that connects together the discharge chamber, the pressure regulation chamber, and the control pressure chamber, and a control valve that adjusts an opening degree of the control passage to change the pressure in the control pressure chamber to allow the movable body to move. The refrigerant in the discharge chamber flows into the control pressure chamber via the pressure regulation chamber. The pressure regulation chamber functions as a muffler that reduces pulsation of the refrigerant.

DETAILED DESCRIPTION OF THE PREFERRED EMBODIMENTS

First and second embodiments of the present invention will now be described with reference to the drawings. A compressor according to the first embodiment is a double-headed swash plate type variable displacement compressor. A compressor according to the second embodiment is a single-headed swash plate type variable displacement compressor. These compressors are installed in vehicles and each is included in the refrigeration circuit in the air conditioner for a vehicle.

First Embodiment

Figure 1:
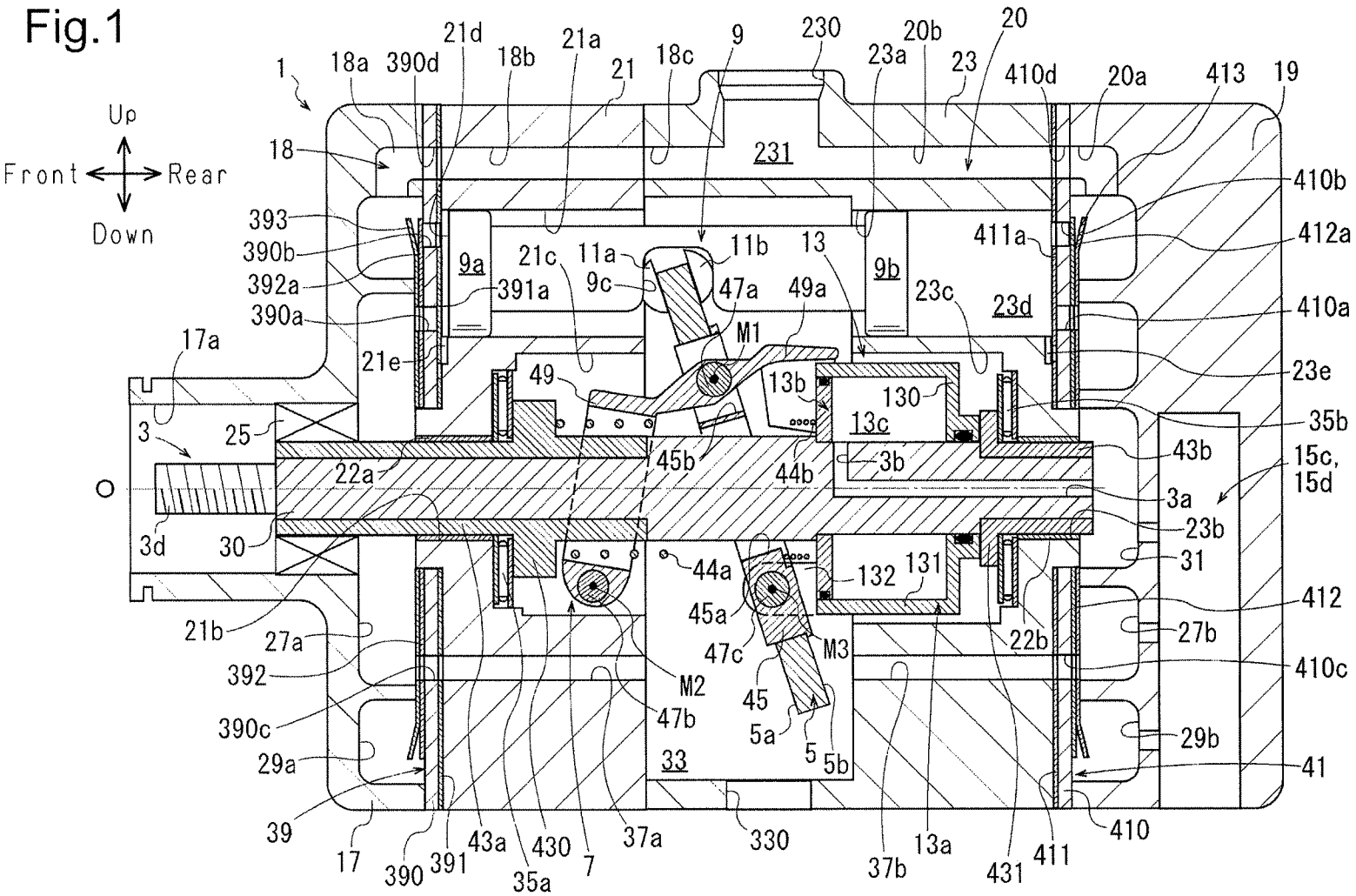
FIG. 1 is a cross-sectional view of a-compressor according to a first embodiment at the maximum displacement.
Figure 2:
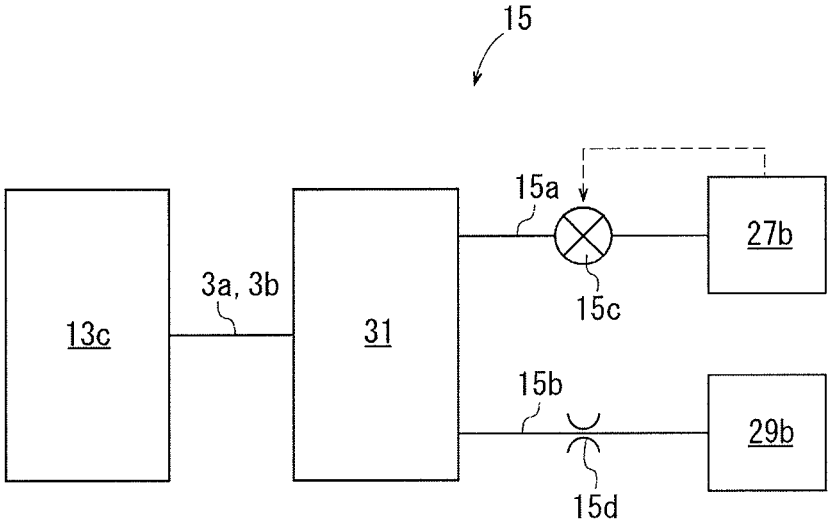
FIG. 2 is a schematic diagram showing a control mechanism of the compressor according to the first embodiment.

As shown in FIG. 1, the compressor according to the first embodiment includes a housing 1, a drive shaft 3, a swash plate 5, a link mechanism 7, pistons 9, pairs of shoes 11*a*, 11*b*, an actuator 13, and a control mechanism 15, which is illustrated in FIG. 2.

As shown in FIG. 1, the housing 1 has a front housing member 17 at a front position in the compressor, a rear housing member 19 at a rear position in the compressor, first and second cylinder blocks 21, 23, which are arranged between the front housing member 17 and the rear housing member 19, and first and second valve forming plates 39, 41.

The front housing member 17 has a boss 17*a*, which projects forward. The boss 17*a* accommodates a shaft sealing device 25. A first suction chamber 27*a* and a first discharge chamber 29*a* are formed in the front housing member 17. The first suction chamber 27*a* is located radially inward in the front housing member 17. The first discharge chamber 29*a* is formed into an annular shape and is located radially outward of the first suction chamber 27*a* in the front housing member 17.

The front housing member 17 further includes a first front communication passage 18*a*. The front end of the first front communication passage 18*a* communicates with the first discharge chamber 29*a*, and the rear end of the first front communication passage 18*a* is open in the rear end of the front housing member 17.

The control mechanism 15 is received in the rear housing member 19. A second suction chamber 27*b*, a second discharge chamber 29*b*, and a pressure regulation chamber 31 are formed in the rear housing member 19. The pressure regulation chamber 31 is formed in the middle of the rear housing member 19. The second suction chamber 27*b* is formed into an annular shape and is located radially outward of the pressure regulation chamber 31 in the rear housing member 19. The second discharge chamber 29*b* is also formed into an annular shape and is located radially outward of the second suction chamber 27*a* in the rear housing member 19. That is, the pressure regulation chamber 31 is formed radially inward of the second discharge chamber 29*b* and the second suction chamber 27*b* in the rear housing member 19. The rear housing member 19 corresponds to a cover according to the present invention.

Since the pressure regulation chamber 31 is formed in the rear housing member 19, the pressure regulation chamber 31 is located at the rear end of the drive shaft 3.

The rear housing member 19 further includes a first rear communication passage 20*a*. The rear end of the first rear communication passage 20*a* communicates with the second discharge chamber 29*b*, and the front end of the first rear communication passage 20*a* is open in the front end of the rear housing member 19.

A swash plate chamber 33 is defined between the first cylinder block 21 and the second cylinder block 23. The swash plate chamber 33 is arranged substantially in the middle of the housing 1 in the front-rear direction.

The first cylinder block 21 includes first cylinder bores 21*a* arranged at equal angular intervals in the circumferential direction and parallel to a rotation axis O of the drive shaft 3. The first cylinder block 21 has a first shaft hole 21*b*, through which the drive shaft 3 is passed. The first shaft hole 21*b* accommodates a first slide bearing 22*a*. Instead of the first slide bearing 22*a*, a roller bearing may be provided.

The first cylinder block 21 further includes a first recess 21*c* that communicates with the first shaft hole 21*b* and is coaxial with the first shaft hole 21*b*. The first recess 21*c* communicates with the swash plate chamber 33 and forms part of the swash plate chamber 33. The diameter of the first recess 21*c* is reduced in a stepwise manner toward the front end. A first thrust bearing 35*a* is arranged at the front end in the first recess 21*c*. The first cylinder block 21 also includes a first connection passage 37*a*, through which the swash plate chamber 33 and the first suction chamber 27*a* communicate with each other. The first cylinder block 21 also includes first retainer grooves 21*e* that limit the maximum opening degree of first suction reed valves 391*a*, which will be discussed below.

The first cylinder block 21 further includes a second front communication passage 18*b*. The front end of the second front communication passage 18*b* is open in the front end of the first cylinder block 21, and the rear end of the second front communication passage 18*b* is open in the rear end of the first cylinder block 21.

As in the first cylinder block 21, a plurality of second cylinder bores 23*a* are formed in the second cylinder block 23. Each of the second cylinder bores 23*a* form a pair with the corresponding one of the first cylinder bores 21*a* in the front-rear direction. The first cylinder bores 21*a* and the second cylinder bores 23*a* have the same diameter.

A second shaft hole 23*b*, through which the drive shaft 3 is inserted, is formed in the second cylinder block 23. The second shaft hole 23*b* communicates with the pressure regulation chamber 31. The second shaft hole 23*b* accommodates a second slide bearing 22*b*. Instead of the second slide bearing 22*b*, a roller bearing may be provided. The first shaft hole 21*b* and the second shaft hole 23*b* correspond to a shaft hole according to the present invention.

In this compressor, the pressure regulation chamber 31 has a diameter greater than those of the first and second shaft holes 21*b*, 23*b*. Thus, when the second cylinder block 23 and the rear housing member 19 are joined via the second valve forming plate 41, the pressure regulation chamber 31 is placed over the second shaft hole 23*b*.

The second cylinder block 23 further includes a second recess 23*c* that communicates with the second shaft hole 23*b* and is coaxial with the second shaft hole 23*b*. The second recess 23*c* also communicates with the swash plate chamber 33 and forms part of the swash plate chamber 33. The diameter of the second recess 23*c* is reduced in a stepwise manner toward the rear end. A second thrust bearing 35*b* is arranged at the rear end in the second recess 23*c*. The second cylinder block 23 also has a second connection passage 37*b*, through which the swash plate chamber 33 and the second suction chamber 27*b* communicate with each other. The second cylinder block 23 also includes second retainer grooves 23*e* that limit the maximum opening degree of second suction reed valves 411*a*, which will be discussed below.

The second cylinder block 23 includes a discharge port 230, a merged discharge chamber 231, a third front communication passage 18*c*, a second rear communication passage 20*b*, and a suction port 330. The discharge port 230 and the merged discharge chamber 231 communicate with each other. The discharge port 230 and the merged discharge chamber 231 are formed at a position closer to the front end of the second cylinder block 23 and are located at substantially the middle of the housing 1 in the front-rear direction. The merged discharge chamber 231 is coupled to a non-illustrated condenser, which forms a conduit, via the discharge port 230.

The front end of the third front communication passage 18*c* is open in the front end of the second cylinder block 23, and the rear end of the third front communication passage 18*c* communicates with the merged discharge chamber 231. The first cylinder block 21 is joined to the second cylinder block 23 so that the third front communication passage 18*c* communicates with the rear end of the second front communication passage 18*b*.

The front end of the second rear communication passage 20*b* communicates with the merged discharge chamber 231, and the rear end of the second rear communication passage 20*b* is open in the rear end of the second cylinder block 23.

The suction port 330 is formed at a position closer to the front end of the second cylinder block 23 and is located at substantially the middle of the housing 1 in the front-rear direction. The swash plate chamber 33 is coupled to a non-illustrated evaporator, which forms a conduit, via the suction port 330.

The first valve forming plate 39 is located between the front housing member 17 and the first cylinder block 21. The second valve forming plate 41 is located between the rear housing member 19 and the second cylinder block 23.

The first valve forming plate 39 includes a first valve plate 390, a first suction valve plate 391, a first discharge valve plate 392, and a first retainer plate 393. The first valve plate 390, the first discharge valve plate 392, and the first retainer plate 393 include first suction holes 390*a*, the number of which is the same as that of the first cylinder bores 21*a*. The first valve plate 390 and the first suction valve plate 391 also include first discharge holes 390*b*, the number of which is the same as that of the first cylinder bores 21*a*. Furthermore, the first valve plate 390, the first suction valve plate 391, the first discharge valve plate 392, and the first retainer plate 393 include a first suction communication hole 390*c*. The first valve plate 390 and the first suction valve plate 391 also include a first discharge communication hole 390*d*.

The first cylinder bores 21*a* communicate with the first suction chamber 27*a* through the corresponding first suction holes 390*a*. The first cylinder bores 21*a* also communicate with the first discharge chamber 29*a* through the corresponding first discharge holes 390*b*. The first suction chamber 27*a* and the first connection passage 37*a* communicate with each other through the first suction communication hole 390*c*. The first front communication passage 18*a* and the second front communication passage 18*b* communicate with each other through the first discharge communication hole 390*d*.

The first suction valve plate 391 is located on the rear surface of the first valve plate 390. The first suction valve plate 391 includes the first suction reed valves 391*a*, which are capable of opening and closing the corresponding first suction holes 390*a* by elastic deformation. The first discharge valve plate 392 is located on the front surface of the first valve plate 390. The first discharge valve plate 392 includes first discharge reed valves 392*a*, which are capable of opening and closing the corresponding first discharge holes 390*b* by elastic deformation. The first retainer plate 393 is located on the front surface of the first discharge valve plate 392. The first retainer plate 393 limits the maximum opening degree of the first discharge reed valves 392*a*.

The second valve forming plate 41 includes a second valve plate 410, a second suction valve plate 411, a second discharge valve plate 412, and a second retainer plate 413. The second valve plate 410, the second discharge valve plate 412, and the second retainer plate 413 include second suction holes 410*a*, the number of which is the same as that of the second cylinder bores 23*a*. The second valve plate 410 and the second suction valve plate 411 include second discharge holes 410*b*, the number of which is the same as that of the second cylinder bores 23*a*. Furthermore, a second suction communication hole 410*c* is formed through the second valve plate 410, the second suction valve plate 411, the second discharge valve plate 412, and the second retainer plate 413. A second discharge communication hole 410*d* is formed through the second valve plate 410 and the second suction valve plate 411.

The second cylinder bores 23*a* communicate with the second suction chamber 27*b* through the corresponding second suction holes 410*a*. The second cylinder bores 23*a* communicate with the second discharge chamber 29*b* through the corresponding second discharge holes 410*b*. The second suction chamber 27*b* and the second connection passage 37*b* communicate with each other through the second suction communication hole 410*c*. The first rear communication passage 20*a* and the second rear communication passage 20*b* communicate with each other through the second discharge communication hole 410*d*.

The second suction valve plate 411 is located on the front surface of the second valve plate 410. The second suction valve plate 411 includes the second suction reed valves 411*a*, which are capable of opening and closing the corresponding second suction holes 410*a* by elastic deformation. The second discharge valve plate 412 is located on the rear surface of the second valve plate 410. The second discharge valve plate 412 includes second discharge reed valves 412*a*, which are capable of opening and closing the corresponding second discharge holes 410*b* by elastic deformation. The second retainer plate 413 is located on the rear surface of the second discharge valve plate 412. The second retainer plate 413 limits the maximum opening degree of the second discharge reed valves 412*a*.

In this compressor, the first front communication passage 18*a*, the first discharge communication hole 390*d*, the second front communication passage 18*b*, and the third front communication passage 18*c* form a first communication passage 18. The first rear communication passage 20*a*, the second discharge communication hole 410*d*, and the second rear communication passage 20*b* form a second communication passage 20.

In this compressor, the first and second connection passages 37*a*, 37*b* and the first and second suction communication holes 390*c*, 410*c* connect the first and second suction chambers 27*a*, 27*b* to the swash plate chamber 33. This substantially equalizes the pressure in the first and second suction chambers 27*a*, 27*b* and the pressure in the swash plate chamber 33. Low-pressure suction refrigerant sent from the evaporator flows into the swash plate chamber 33 via the suction port 330. As a result, the pressure in the swash plate chamber 33 and the pressure in the first and second suction chambers 27*a*, 27*b* are lower than the pressure in the first and second discharge chambers 29*a*, 29*b*.

The drive shaft 3 includes a drive shaft main body 30, a first support member 43*a*, and a second support member 43*b*. The drive shaft main body 30 extends rearward from the front of the housing 1, is inserted in the boss 17*a* toward the rear end, and is inserted in the first and second slide bearings 22*a*, 22*b*. Thus, the drive shaft main body 30, or the drive shaft 3, is rotationally supported by the housing 1 about the rotation axis O. The front end of the drive shaft main body 30 is located inside the boss 17*a* and the rear end of the drive shaft main body 30 is located inside the pressure regulation chamber 31.

The swash plate 5, the link mechanism 7, and the actuator 13 are provided on the drive shaft main body 30. The swash plate 5, the link mechanism 7, and the actuator 13 are arranged in the swash plate chamber 33.

The first support member 43*a* is press-fitted to the front end of the drive shaft main body 30. When the drive shaft 3 is rotated about the rotation axis O, the first support member 43*a* slides in the first slide bearing 22*a*. The first support member 43*a* has a flange 430 that contacts the first thrust bearing 35*a* and an attachment portion (not shown) through which a second pin 47*b* is passed as will be described below. Furthermore, the front end of a first restoration spring 44*a* is secured to the first support member 43*a*. The first restoration spring 44*a* extends along the rotation axis O from the first support member 43*a* toward the swash plate chamber 33.

The second support member 43*b* is press-fitted to the rear end of the drive shaft main body 30. When the drive shaft 3 is rotated about the rotation axis O, the second support member 43*b* slides in the second slide bearing 22*b*. The second support member 43*b* also has a flange 431 that contacts the second thrust bearing 35*b*. The flange 431 is arranged between the second thrust bearing 35*b* and the actuator 13.

The swash plate 5 is shaped as a flat annular plate and has a front surface 5*a* and a rear surface 5*b*. The front surface 5*a* faces forward of the compressor in the swash plate chamber 33. The rear surface 5*b* faces rearward of the compressor in the swash plate chamber 33.

The swash plate 5 is fixed to a ring plate 45. The ring plate 45 is shaped as a flat annular plate. The ring plate 45 includes a through hole 45*a* at the central portion. The drive shaft main body 30 is inserted in the through hole 45*a* in the swash plate chamber 33 so that the swash plate 5 is mounted on the drive shaft 3.

Figure 3:
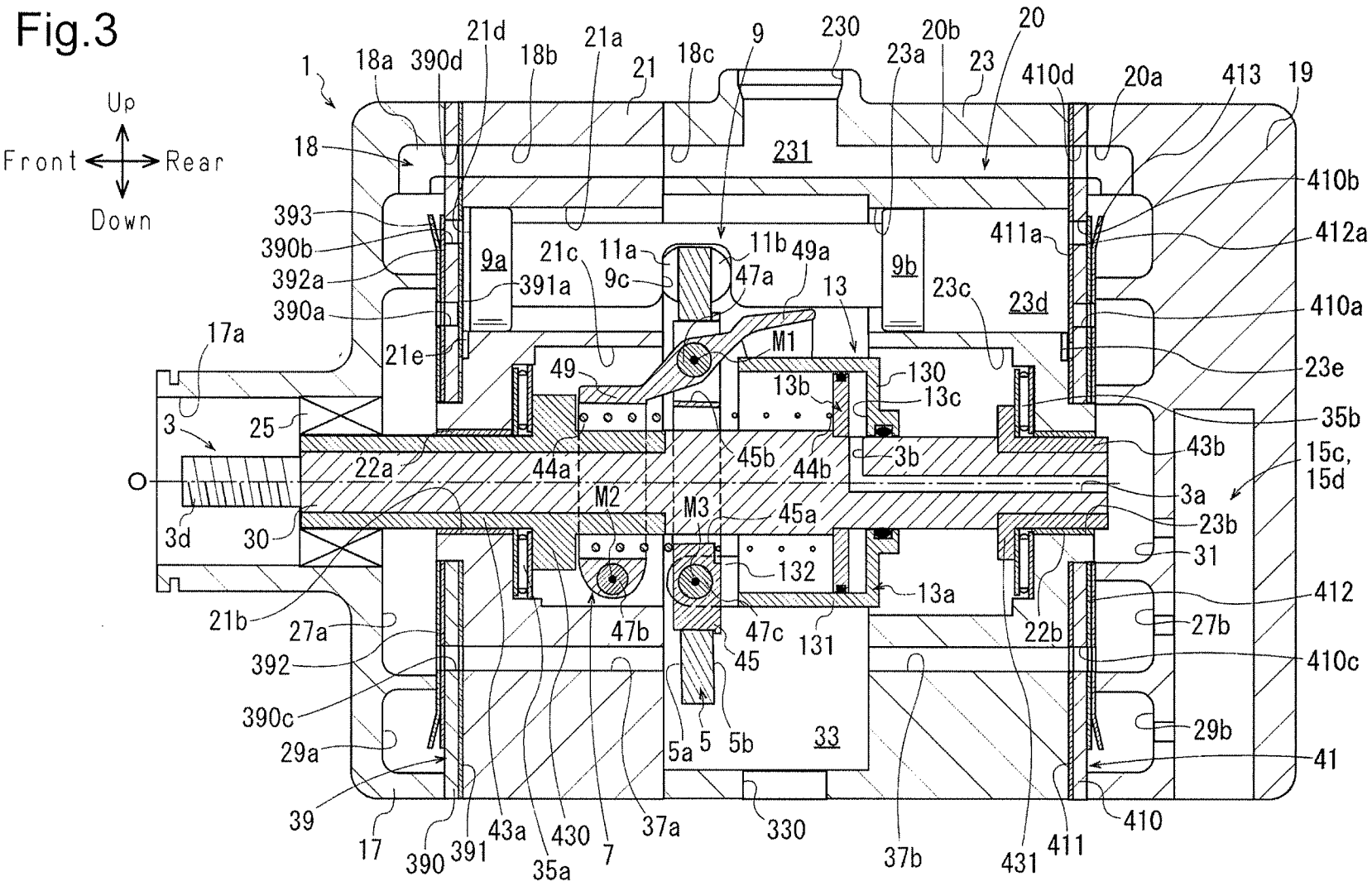
FIG. 3 is a cross-sectional view of the compressor according to the first embodiment at the minimum displacement.

The link mechanism 7 has a lug arm 49. The lug arm 49 is arranged forward of the swash plate 5 in the swash plate chamber 33 and located between the swash plate 5 and the first support member 43*a*. The lug arm 49 substantially has an L shape extending from the front end to the rear end. As illustrated in FIG. 3, the lug arm 49 comes into contact with the flange 430 of the first support member 43*a* when the inclination angle of the swash plate 5 with respect to the rotation axis O is minimized. This compressor thus allows the lug arm 49 to maintain the swash plate 5 at the minimum inclination angle. A weight portion 49*a* is formed at the rear end of the lug arm 49. The weight portion 49*a* extends in the circumferential direction of the actuator 13 over approximately half the circumference. The shape of the weight portion 49*a* may be changed as necessary.

As shown in FIG. 1, the rear portion of the lug arm 49 is coupled to a portion on a first side of the ring plate 45 via a first pin 47*a*. This configuration supports the front portion of the lug arm 49 to be capable of pivoting about the axis of the first pin 47*a*, which is a first pivot axis M1, relative to the first side portion of the ring plate 45, or in other words, relative to the swash plate 5. The first pivot axis M1 extends perpendicular to the rotation axis O of the drive shaft 3.

The front portion of the lug arm 49 is coupled to the first support member 43*a* with the second pin 47*b*. This configuration supports the rear portion of the lug arm 49 to be capable of pivoting about the axis of the second pin 47*b*, which is a second pivot axis M2, relative to the first support member 43*a*, or in other words, relative to the drive shaft 3. The second pivot axis M2 extends parallel to the first pivot axis M1. The lug arm 49 and the first and second pins 47*a*, 47*b* correspond to the link mechanism 7 according to the present invention.

The weight portion 49*a* extends in the rear end of the lug arm 49, that is, opposite to the second pivot axis M2 with respect to the first pivot axis M1. Thus, the lug arm 49 is supported by the ring plate 45 with the first pin 47*a* so that the weight portion 49*a* passes through a groove portion 45*b* of the ring plate 45 and is located on the rear surface of the ring plate 45, that is, rearward of the rear surface 5*b* of the swash plate 5. As a result, the centrifugal force produced by rotation of the swash plate 5 about the rotation axis O is applied to the weight portion 49*a* at the rear surface 5*b* of the swash plate 5.

In this compressor, the swash plate 5 is allowed to rotate together with the drive shaft 3 by connection between the swash plate 5 and the drive shaft 3 through the link mechanism 7. The inclination angle of the swash plate 5 is changed through pivoting of the opposite ends of the lug arm 49 about the first pivot axis M1 and the second pivot axis M2.

The pistons 9 each include a first piston head 9*a* at the front end and a second piston head 9*b* at the rear end. The first piston heads 9*a* are respectively accommodated in the first cylinder bores 21*a* to be capable of reciprocating in the first cylinder bores 21*a*. The first piston heads 9*a* and the first valve forming plate 39 define first compression chambers 21*d* respectively in the first cylinder bores 21*a*. The second piston heads 9*b* are respectively accommodated in the second cylinder bores 23*a* to be capable of reciprocating in the second cylinder bores 23*a*. The second piston heads 9*b* and the second valve forming plate 41 define second compression chambers 23*d* respectively in the second cylinder bores 23*a*. Since the first cylinder bores 21*a* and the second cylinder bores 23*a* have the same diameter as described above, the first piston heads 9*a* and the second piston heads 9*b* have the same diameter.

Each of the pistons 9 has an engaging portion 9*c* at the middle. Each of the engaging portions 9*c* accommodates the pair of hemispherical shoes 11*a*, 11*b*. The shoes 11*a*, 11*b* convert rotation of the swash plate 5 into reciprocation of the pistons 9. The shoes 11*a*, 11*b* correspond to a conversion mechanism according to the present invention. The first and second piston heads 9*a*, 9*b* thus reciprocate in the corresponding first and second cylinder bores 21*a*, 23*a* by the stroke corresponding to the inclination angle of the swash plate 5.

The compressor shifts the top dead center positions of the first piston heads 9*a* and the second piston heads 9*b* by varying the stroke of the pistons 9 in accordance with change in the inclination angle of the swash plate 5. More specifically, as shown in FIG. 1, when the inclination angle of the swash plate 5 and the stroke of the pistons 9 are maximized, the top dead center position of each first piston head 9*a* is the closest to the first valve forming plate 39, and the top dead center position of each second piston head 9*b* is the closest to the second valve forming plate 41. As shown in FIG. 3, as the inclination angle of the swash plate 5 is decreased and the stroke of the pistons 9 is decreased, the top dead center position of each second piston head 9*b* is gradually separated away from the second valve forming plate 41. However, the top dead center position of each first piston head 9*a* scarcely changes from the case in which the stroke of the pistons 9 is maximized and is maintained in the vicinity of the first valve forming plate 39. That is, the compressor shifts the top dead center position of each second piston head 9*b* by a greater amount than the top dead center position of each first piston head 9*a* as the inclination angle of the swash plate 5 is decreased.

As shown in FIG. 1, the actuator 13 is arranged in the swash plate chamber 33. The actuator 13 is located rearward of the swash plate 5 to be able to enter the second recess 23*c*. The actuator 13 includes a movable body 13*a*, a fixed body 13*b*, and a control pressure chamber 13*c*. The control pressure chamber 13*c* is defined between the movable body 13*a* and the fixed body 13*b*.

The movable body 13*a* includes a main body portion 130 and a circumferential wall 131. The main body portion 130 is located at the rear part of the movable body 13*a* and extends radially in a direction to separate from the rotation axis O. The circumferential wall 131 is continuous with the periphery of the main body portion 130 and extends rearward from the front. A coupling portion 132 is formed on the front end of the circumferential wall 131. The main body portion 130, the circumferential wall 131, and the coupling portion 132 form the movable body 13*a* into a cylindrical cup shape.

The fixed body 13*b* has a disk-like shape the diameter of which is substantially equal to the inner diameter of the movable body 13*a*. A second restoration spring 44*b* is provided between the fixed body 13*b* and the ring plate 45. More specifically, the rear end of the second restoration spring 44*b* is secured to the fixed body 13*b*, and the front end of the second restoration spring 44*b* is secured to a portion on a second side of the ring plate 45.

The drive shaft main body 30 is inserted in the movable body 13*a* and the fixed body 13*b*. At this time, the movable body 13*a* is accommodated in the second recess 23*c* and faces the link mechanism 7 with the swash plate 5 located in between. The fixed body 13*b* is arranged in the movable body 13*a* rearward of the swash plate 5 and is surrounded by the circumferential wall 131. This defines the control pressure chamber 13*c* between the movable body 13*a* and the fixed body 13*b*. The control pressure chamber 13*c* is partitioned from the swash plate chamber 33 by the main body portion 130 of the movable body 13*a*, the circumferential wall 131, and the fixed body 13*b*.

In addition to the main body portion 130 and the circumferential wall 131 of the movable body 13*a* and the fixed body 13*b*, the drive shaft 3, the rear housing member 19, and the second cylinder block 23 partition the pressure regulation chamber 31 from the control pressure chamber 13*c*.

In this compressor, since the drive shaft main body 30 is inserted in the movable body 13*a*, the movable body 13*a* is rotational with the drive shaft 3 and is permitted to move along the rotation axis O of the drive shaft 3 in the swash plate chamber 33. The fixed body 13*b*, however, is secured to the drive shaft main body 30 with the drive shaft main body 30 inserted in the fixed body 13*b*. This permits the fixed body 13*b* to only rotate with the drive shaft 3 and prevents the fixed body 13*b* to move like the movable body 13*a*. Thus, the movable body 13*a* moves relative to the fixed body 13*b* when moving along the rotation axis O.

The second side portion of the ring plate 45 is coupled to the coupling portion 132 of the movable body 13*a* with a third pin 47*c*. Thus, the second side portion of the ring plate 45, that is, the swash plate 5 is pivotally supported by the movable body 13*a* about the axis of the third pin 47*c*, which is an operation axis M3. The operation axis M3 extends parallel to the first and second pivot axes M1, M2. The movable body 13*a* is thus held in a state connected to the swash plate 5. When the inclination angle of the swash plate 5 is maximized, the movable body 13*a* contacts the flange 431 of the second support member 43*b*.

The drive shaft main body 30 has an axial passage 3*a*, which extends forward from the rear end along the rotation axis O, and a radial passage 3*b*, which extends radially from the front end of the axial passage 3*a* and has an opening in the outer peripheral surface of the drive shaft main body 30. The rear end of the axial passage 3*a* has an opening in the pressure regulation chamber 31. The radial passage 3*b* has an opening in the control pressure chamber 13*c*. Thus, the control pressure chamber 13*c* communicates with the pressure regulation chamber 31 via the radial passage 3*b* and the axial passage 3*a*.

A threaded portion 3*d* is formed at the distal end of the drive shaft main body 30. The drive shaft 3 is connected to a non-illustrated pulley or a non-illustrated electromagnetic clutch through the threaded portion 3*d*.

As shown in FIG. 2, the control mechanism 15 includes a low-pressure passage 15*a*, a high-pressure passage 15*b*, a control valve 15*c*, an orifice 15*d*, the axial passage 3*a*, and the radial passage 3*b*. The axial passage 3*a* and the radial passage 3*b* correspond to a variable pressure passage according to the present invention. Furthermore, the low-pressure passage 15*a*, the high-pressure passage 15*b*, the axial passage 3*a*, and the radial passage 3*b* form a control passage according to the present invention.

The low-pressure passage 15*a* is connected to the pressure regulation chamber 31 and the second suction chamber 27*b*. The low-pressure passage 15*a*, the axial passage 3*a*, and the radial passage 3*b* connect the control pressure chamber 13*c*, the pressure regulation chamber 31, and the second suction chamber 27*b* with one another. The high-pressure passage 15*b* is connected to the pressure regulation chamber 31 and the second discharge chamber 29*b*. The discharge refrigerant in the second discharge chamber 29*b* flows through the high-pressure passage 15*b*. The high-pressure passage 15*b*, the axial passage 3*a*, and the radial passage 3*b* connect the control pressure chamber 13*c*, the pressure regulation chamber 31, and the second discharge chamber 29*b*. The high-pressure passage 15*b* also has the orifice 15*d*.

Since the second suction chamber 27*b* and the second discharge chamber 29*b*, the pressure regulation chamber 31, and the control pressure chamber 13*c* are connected as described above, the pressure regulation chamber 31 is located between the control pressure chamber 13*c* and both the second suction chamber 27*b* and the second discharge chamber 29*b*. Furthermore, the pressure regulation chamber 31 is a space that has a cross-sectional area that is greater than the cross-sectional area of any of the low-pressure passage 15*a*, the high-pressure passage 15*b*, the axial passage 3*a*, and the radial passage 3*b*.

The control valve 15*c* is arranged in the low-pressure passage 15*a*. The control valve 15*c* is capable of adjusting the opening degree of the low-pressure passage 15*a* in accordance with the pressure in the second suction chamber 27*b*.

In the compressor shown in FIG. 1, a pipe coupled to the evaporator is coupled to the suction port 330, and a pipe coupled to the condenser is coupled to the discharge port 230. The condenser is coupled to the evaporator via a pipe and an expansion valve. The compressor, the evaporator, the expansion valve, and the condenser are included in the refrigeration circuit in the air conditioner for a vehicle. The illustration of the evaporator, the expansion valve, the condenser, and the pipes is omitted.

In the compressor having the above-described configuration, the drive shaft 3 rotates to rotate the swash plate 5, thus reciprocating the pistons 9 in the corresponding first and second cylinder bores 21*a*, 23*a*. This varies the volume of each first compression chamber 21*d* and the volume of each second compression chamber 23*d* in correspondence with the piston stroke. The compressor thus repeatedly performs a suction stroke for drawing in the suction refrigerant into the first and second compression chambers 21*d*, 23*d*, a compression stroke for compressing the suction refrigerant in the first and second compression chambers 21*d*, 23*d*, and a discharge stroke for discharging the compressed suction refrigerant from the first and second compression chambers 21*d*, 23*d* as the discharge refrigerant.

During the suction stroke, the suction refrigerant that has been drawn from the evaporator into the swash plate chamber 33 through the suction port 330 flows through the first connection passage 37*a* to the first suction chamber 27*a*. The suction refrigerant that has reached the first suction chamber 27*a* is drawn into the first compression chambers 21*d* as the first suction reed valves 391*a* open the first suction holes 390*a* by the pressure difference between the first compression chambers 21*d* and the first suction chamber 27*a*. Similarly, the suction refrigerant that has been drawn into the swash plate chamber 33 from the evaporator through the suction port 330 flows through the second connection passage 37*b* to the second suction chamber 27*b*. The suction refrigerant that has reached the second suction chamber 27*b* is drawn into the second compression chambers 23*d* as the second suction reed valves 411*a* open the second suction holes 410*a* by the pressure difference between the second compression chambers 23*d* and the second suction chamber 27*b*.

Furthermore, during the discharge stroke, the suction refrigerant that has been compressed in the first compression chambers 21*d* is discharged into the first discharge chamber 29*a* as the discharge refrigerant and flows through the first communication passage 18 to the merged discharge chamber 231. Similarly, the suction refrigerant that has been compressed in the second compression chambers 23*d* is discharged to the second discharge chamber 29*b* as the discharge refrigerant and flows through the second communication passage 20 to the merged discharge chamber 231. The discharge refrigerant that has reached the merged discharge chamber 231 is discharged to the condenser through the discharge port 230.

During the suction stroke or the like, a rotor that is formed by the swash plate 5, the ring plate 45, the lug arm 49, and the first pin 47*a* receive the piston compression force acting to decrease the inclination angle of the swash plate 5. Through such change of the inclination angle of the swash plate 5, displacement control is carried out by selectively increasing and decreasing the stroke of each piston 9.

More specifically, when the control valve 15*c* of the control mechanism 15 shown in FIG. 2 increases the opening degree of the low-pressure passage 15*a*, the pressure in the pressure regulation chamber 31 and thus the pressure in the control pressure chamber 13*c* become substantially equal to the pressure in the second suction chamber 27*b*. The piston compression force acting on the swash plate 5 thus moves the movable body 13*a* of the actuator 13 forward of the swash plate chamber 33 as shown in FIG. 3. Thus, in this compressor, the movable body 13*a* approaches the lug arm 49 and reduces the volume of the control pressure chamber 13*c*.

Consequently, the second side portion of the ring plate 45, that is, the second side portion of the swash plate 5 pivots clockwise about the operation axis M3 against the urging force of the second restoration spring 44*b*. Also, the rear end of the lug arm 49 pivots counterclockwise about the first pivot axis M1 and the front end of the lug arm 49 pivots counterclockwise about the second pivot axis M2. The lug arm 49 thus approaches the flange 430 of the first support member 43*a*. In this manner, the swash plate 5 pivots with the operation axis M3 serving as a point of application and with the first pivot axis M1 serving as a fulcrum. This reduces the inclination angle of the swash plate 5 relative to the rotation axis O of the drive shaft 3 and reduces the stroke of the pistons 9. Thus, the displacement of the compressor per rotation of the drive shaft 3 is reduced. The inclination angle of the swash plate 5 shown in FIG. 3 corresponds to the minimum inclination angle in the compressor.

The swash plate 5 of this compressor receives the centrifugal force acting on the weight portion 49*a*. Thus, the swash plate 5 easily moves in such a direction as to decrease the inclination angle. Since the movable body 13*a* moves forward of the swash plate chamber 33, the front end of the movable body 13*a* is located inward of the weight portion 49*a*. As a result, when the inclination angle of the swash plate 5 is decreased, the weight portion 49*a* overlaps with approximately a half the front end of the movable body 13*a*.

When the inclination angle of the swash plate 5 is reduced, the ring plate 45 contacts the rear end of the first restoration spring 44*a*. This elastically deforms the first restoration spring 44*a*, and the rear end of the first restoration spring 44*a* approaches the first support member 43*a*.

When the inclination angle of the swash plate 5 is reduced, and the stroke of the pistons 9 is reduced, the top dead center position of each second piston head 9*b* is separated away from the second valve forming plate 41. Thus, when the inclination angle of the swash plate 5 approaches zero degrees, compression work is not performed in the second compression chambers 23*d* while compression is slightly performed in the first compression chambers 21*d*.

When the control valve 15*c* shown in FIG. 2 reduces the opening degree of the low-pressure passage 15*a*, the pressure in the pressure regulation chamber 31 is increased, and the pressure in the control pressure chamber 13*c* is increased. Thus, the movable body 13*a* of the actuator 13 moves rearward of the swash plate chamber 33 against the piston compression force acting on the swash plate 5 as shown in FIG. 1. Thus, in this compressor, the movable body 13*a* is separated away from the lug arm 49, and the volume of the control pressure chamber 13*c* is increased.

Consequently, the movable body 13*a* pulls the lower part of the swash plate 5 rearward of the swash plate chamber 33 via the coupling portion 132 at the operation axis M3. This pivots the second side portion of the swash plate 5 counterclockwise about the operation axis M3. Furthermore, the rear end of the lug arm 49 pivots clockwise about the first pivot axis M1, and the front end of the lug arm 49 pivots clockwise about the second pivot axis M2. The lug arm 49 is thus separated from the flange 430 of the first support member 43*a*. This pivots the swash plate 5 in the opposite direction to the direction in the case where the inclination angle decreases, with the operation axis M3 and the first pivot axis M1 serving as the point of application and the fulcrum, respectively. The inclination angle of the swash plate 5 with respect to the rotation axis O of the drive shaft 3 is thus increased. This increases the stroke of the pistons 9, thus raising the displacement of the compressor per rotation of the drive shaft 3. The inclination angle of the swash plate 5 shown in FIG. 1 corresponds to the maximum inclination angle in the compressor.

As described above, in this compressor, when the pressure in the control pressure chamber 13*c* is increased, and the movable body 13*a* is separated away from the fixed body 13*b*, the volume of the control pressure chamber 13*c* is increased. When the pressure in the control pressure chamber 13*c* is reduced, and the movable body 13*a* approaches the fixed body 13*b*, the volume of the control pressure chamber 13*c* is reduced as shown in FIG. 3. That is, the displacement of the compressor per rotation of the drive shaft 3 is increased as the volume of the control pressure chamber 13*c* is increased. In contrast, the displacement per rotation of the drive shaft 3 is reduced as the volume of the control pressure chamber 13*c* is reduced.

In this compressor, the pressure regulation chamber 31 formed in the rear housing member 19 functions as a muffler that reduces the pulsation of the discharge refrigerant and the suction refrigerant. In this compressor, the volume of the pressure regulation chamber 31 is greater than the volume of the control pressure chamber 13*c* when the displacement is minimized and until the displacement is increased to a certain amount from the minimum.

In this compressor, the pressure regulation chamber 31 is arranged between the control pressure chamber 13*c* and both the second suction chamber 27*b* and the second discharge chamber 29*b*. Thus, in this compressor, when the discharge refrigerant in the second discharge chamber 29*b* flows into the control pressure chamber 13*c* via the pressure regulation chamber 31, the pulsation of the discharge refrigerant is reduced in the pressure regulation chamber 31 before flowing into the control pressure chamber 13*c*.

In this compressor, the pressure regulation chamber 31 also reduces the pulsation of the suction refrigerant in the second suction chamber 27*b*. Since the actuator 13 is unlikely to be influenced by the pulsation of the discharge refrigerant and the suction refrigerant when changing the inclination angle of the swash plate 5, the compressor is allowed to stabilize the inclination angle of the swash plate 5.

Since the pressure regulation chamber 31 has a diameter greater than those of the first and second shaft holes 21*b*, 23*b* and a passage cross-sectional area greater than that of any of the low-pressure passage 15*a*, the high-pressure passage 15*b*, the axial passage 3*a*, and the radial passage 3*b*, the volume of the pressure regulation chamber 31 is sufficient. Thus, the pressure regulation chamber 31 favorably functions as a muffler and is allowed to sufficiently reduce the pulsation of the discharge refrigerant and the suction refrigerant.

In particular, in this compressor, as the inclination angle of the swash plate 5 approaches zero degrees, the volume of the control pressure chamber 13*c* is reduced. Furthermore, when the inclination angle approaches zero degrees, no compression work is performed in the second compression chambers 23*d*. Thus, when the inclination angle approaches zero degrees, the actuator 13 is apt to be significantly affected by the pulsation of the discharge refrigerant and the suction refrigerant. In this respect, since the pressure regulation chamber 31 reduces the pulsation of, for example, the discharge refrigerant as described above, the inclination angle of the swash plate 5 is stable even when the volume of the control pressure chamber 13*c* is small, or the displacement is small.

Thus, the compressor of the first embodiment is capable of operating at a suitable displacement.

Second Embodiment

Figure 4:
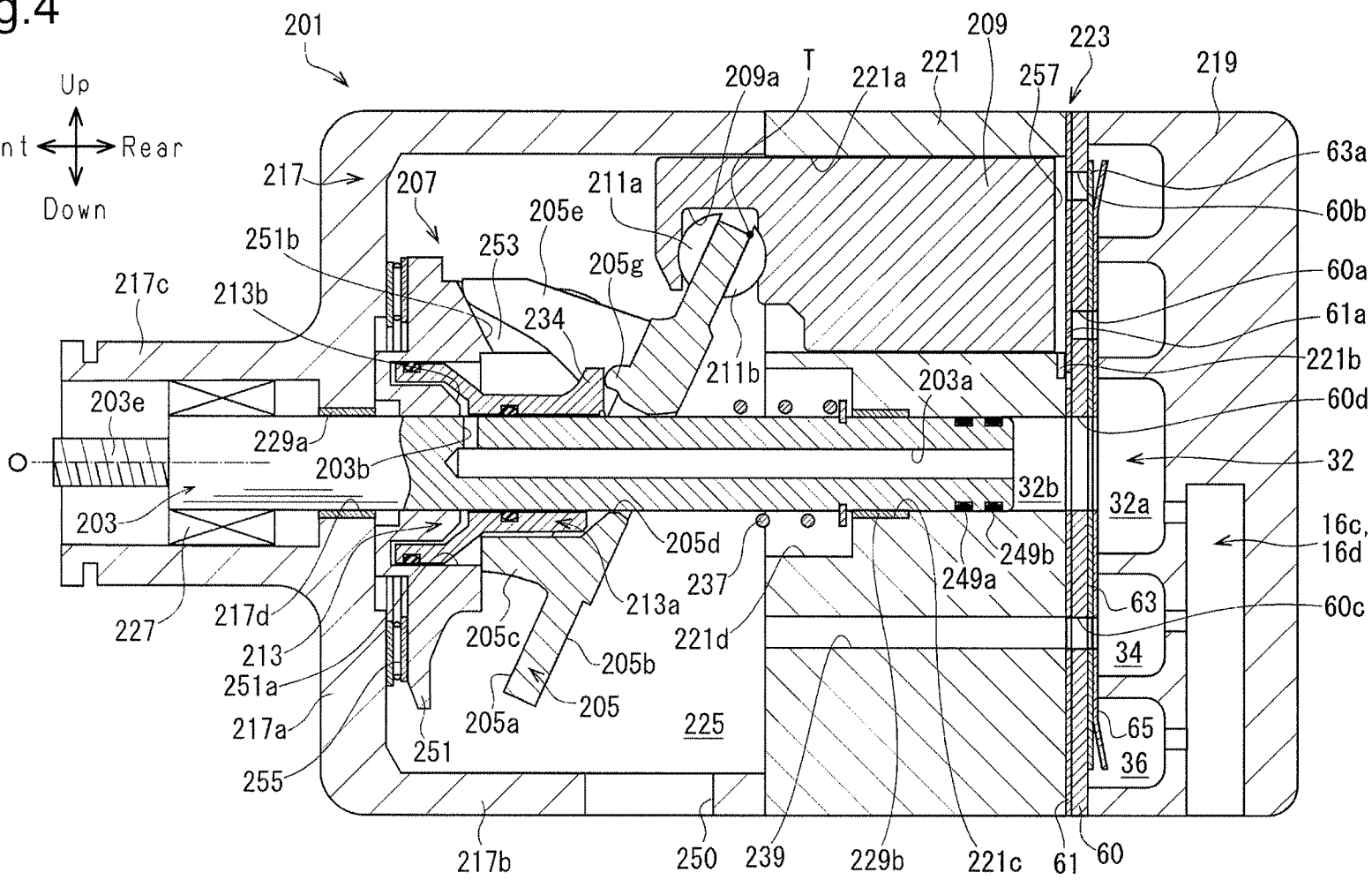
FIG. 4 is a cross-sectional view of a compressor according to a second embodiment at the maximum displacement.
Figure 5:
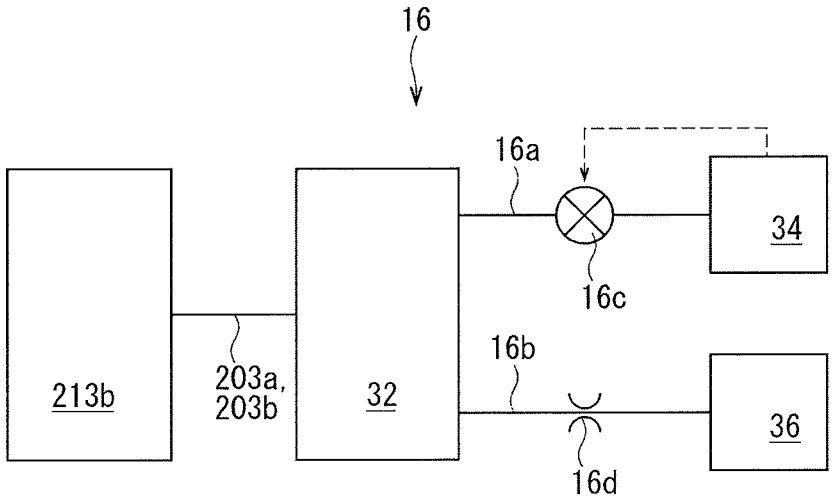
FIG. 5 is a schematic diagram showing a control mechanism of the compressor according to the second embodiment.

As shown in FIG. 4, a compressor according to a second embodiment includes a housing 201, a drive shaft 203, a swash plate 205, a link mechanism 207, pistons 209, pairs of shoes 211*a*, 211*b*, an actuator 213, and a control mechanism 16, which is illustrated in FIG. 5.

As shown in FIG. 4, the housing 201 has a front housing member 217 at a front position in the compressor, a rear housing member 219 at a rear position in the compressor, and a cylinder block 221 and a valve forming plate 223, which are arranged between the front housing member 217 and the rear housing member 219.

The front housing member 217 includes a front wall 217*a*, which extends in the vertical direction of the compressor on the front side, and a circumferential wall 217*b*, which is integrally formed with the front wall 217*a* and extends rearward from the front of the compressor. The front housing member 217 is formed into a substantially cylindrical cup shape with the front wall 217*a* and the circumferential wall 217*b*. Furthermore, the front wall 217*a* and the circumferential wall 217*b* define a swash plate chamber 225 in the front housing member 217.

The front wall 217*a* has a boss 217*c*, which projects forward. The boss 217*c* accommodates a shaft sealing device 227. The boss 217*c* has a first shaft hole 217*d*, which extends in the front-rear direction of the compressor. The first shaft hole 217*d* accommodates a first slide bearing 229*a*.

The circumferential wall 217*b* has a suction port 250 that communicates with the swash plate chamber 225. The swash plate chamber 225 is connected to a non-illustrated evaporator through the suction port 250.

A part of the control mechanism 16 is received in the rear housing member 219. The rear housing member 219 includes a first pressure regulation chamber 32*a*, a suction chamber 34, and a discharge chamber 36. The first pressure regulation chamber 32*a* is located in the central part of the rear housing member 219. The discharge chamber 36 is located radially outward of the rear housing member 219 in an annular form. Also, the suction chamber 34 is formed into an annular shape between the first pressure regulation chamber 32*a* and the discharge chamber 36 in the rear housing member 219. The discharge chamber 36 is connected to a non-illustrated discharge port. The rear housing member 219 also corresponds to a cover according to the present invention.

The cylinder block 221 includes cylinder bores 221*a*, the number of which is the same as that of the pistons 209. The cylinder bores 221*a* are arranged at equal angular intervals in the circumferential direction. The front ends of the cylinder bores 221*a* communicate with the swash plate chamber 225. The cylinder block 221 also includes retainer grooves 221*b* that limit the maximum opening degree of suction reed valves 61*a*, which will be discussed below.

The cylinder block 221 further includes a second shaft hole 221*c*, which communicates with the swash plate chamber 225 and extends in the front-rear direction of the compressor. The second shaft hole 221*c* accommodates a second slide bearing 229*b*. The first shaft hole 217*d* and the second shaft hole 221*c* also correspond to a shaft hole according to the present invention.

The first pressure regulation chamber 32*a* of this compressor has a diameter greater than those of the first and second shaft holes 217*d*, 221*c*. Thus, when the cylinder block 221 and the rear housing member 219 are joined via the valve forming plate 223, the first pressure regulation chamber 32*a* is placed over the second shaft hole 221*c* also.

The cylinder block 221 further has a spring chamber 221*d*. The spring chamber 221*d* is located between the swash plate chamber 225 and the second shaft hole 221*c*. The spring chamber 221*d* accommodates a restoration spring 237. The restoration spring 237 urges the swash plate 205 forward of the swash plate chamber 225 when the inclination angle is minimized. The cylinder block 221 also includes a suction passage 239 that communicates with the swash plate chamber 225.

In this compressor, the swash plate chamber 225 communicates with the suction chamber 34 through the suction passage 239. Thus, the pressure in the suction chamber 34 is substantially equal to the pressure in the swash plate chamber 225. Since low-pressure suction refrigerant that has passed through the evaporator flows into the swash plate chamber 225 via the suction port 250, the pressures in the swash plate chamber 225 and the suction chamber 34 are lower than the pressure in the discharge chamber 36.

The valve forming plate 223 is located between the rear housing member 219 and the cylinder block 221. The valve forming plate 223 includes a valve plate 60, a suction valve plate 61, a discharge valve plate 63, and a retainer plate 65.

The valve plate 60, the discharge valve plate 63, and the retainer plate 65 include suction holes 60*a*, the number of which is equal to that of the cylinder bores 221*a*. Furthermore, the valve plate 60 and the suction valve plate 61 include discharge holes 60*b*, the number of which is equal to that of the cylinder bores 221*a*. The cylinder bores 221*a* communicate with the suction chamber 34 through the suction holes 60*a* and communicate with the discharge chamber 36 through the discharge holes 60*b*. Furthermore, the valve plate 60, the suction valve plate 61, the discharge valve plate 63, and the retainer plate 65 include a first communication hole 60*c* and a second communication hole 60*d*. The first communication hole 60*c* connects the suction chamber 34 to the suction passage 239.

The suction valve plate 61 is provided on the front surface of the valve plate 60. The suction valve plate 61 includes suction reed valves 61*a* that are capable of opening and closing the suction holes 60*a* by elastic deformation. The discharge valve plate 63 is located on the rear surface of the valve plate 60. The discharge valve plate 63 includes discharge reed valves 63*a* that are capable of opening and closing the discharge holes 60*b* by elastic deformation. The retainer plate 65 is provided on the rear surface of the discharge valve plate 63. The retainer plate 65 limits the maximum opening degree of the discharge reed valves 63*a*.

The drive shaft 203 is inserted in the boss 217*c* toward the rear of the housing 201. The front portion of the drive shaft 203 extends through the shaft sealing device 227 in the boss 217*c* and is supported by the first slide bearing 229*a* in the first shaft hole 217*d*. The rear portion of the drive shaft 203 is supported by the second slide bearing 229*b* in the second shaft hole 221*c*. In this manner, the drive shaft 203 is supported to be rotational about the rotation axis O relative to the housing 201. The second shaft hole 221*c* and the rear end of the drive shaft 203 define a second pressure regulation chamber 32*b*. The second pressure regulation chamber 32*b* communicates with the first pressure regulation chamber 32*a* through the second communication hole 60*d*. The first and second pressure regulation chambers 32*a*, 32*b* form a pressure regulation chamber 32.

Sealing rings 249*a*, 249*b* are provided on the rear end of the drive shaft 3. The pressure regulation chamber 32 is sealed by the sealing rings 249*a*, 249*b* so that the swash plate chamber 225 does not communicate with the pressure regulation chamber 32.

The link mechanism 207, the swash plate 205, and the actuator 213 are mounted on the drive shaft 203. The link mechanism 207 includes a lug plate 251, a pair of lug arms 253 formed on the lug plate 251, and a pair of swash plate arms 205*e* formed on the swash plate 205. In the drawing, only one of the lug arms 253 and one of the swash plate arms 205*e* are shown. The same applies to FIG. 6.

As shown in FIG. 4, the lug plate 251 has a substantially annular shape. The lug plate 251 is press-fitted to the drive shaft 203 and rotates integrally with the drive shaft 203. The lug plate 251 is located at the front section in the swash plate chamber 225 and is located forward of the swash plate 205. A thrust bearing 255 is located between the lug plate 251 and the front wall 217*a*.

The lug plate 251 has a cylinder chamber 251*a* that extends in the front-rear direction of the lug plate 251. The cylinder chamber 251*a* extends from the rear end surface of the lug plate 251 to a position in the lug plate 251 that corresponds to the interior of the thrust bearing 255.

The lug arms 253 extend rearward from the lug plate 251. The lug plate 251 includes a sliding surface 251*b* at a position between the lug arms 253.

The swash plate 205 is shaped as a flat annular plate and has a front surface 205*a* and a rear surface 205*b*. The front surface 205*a* has a weight portion 205*c*, which projects forward of the swash plate 205. When the inclination angle of the swash plate 205 is maximized, the weight portion 205*c* contacts the lug plate 251. Furthermore, a through hole 205*d* is formed at the center of the swash plate 205. The drive shaft 203 is inserted in the through hole 205*d*.

The swash plate arms 205*e* are formed on the front surface 205*a*. The swash plate arms 205*e* extend forward from the front surface 205*a*. The swash plate 205 also has a substantially semicircular projection 205*g*, which projects from the front surface 205*a* and is integrally formed with the front surface 205*a*. The projection 205*g* is located between the swash plate arms 5*e*.

In this compressor, the swash plate arms 205*e* are inserted between the lug arms 253 so that the lug plate 251 and the swash plate 205 are coupled with each other. Thus, the swash plate 205 is rotational in the swash plate chamber 225 together with the lug plate 251. Coupling the lug plate 251 with the swash plate 205 in this manner causes the distal ends of the swash plate arms 205*e* to contact the sliding surface 251*b*. The swash plate arms 205*e* slide along the sliding surface 251*b* so that the swash plate 205 is allowed to change the inclination angle relative to the direction perpendicular to the rotation axis O from the maximum inclination angle shown in the drawing to the minimum inclination angle shown in FIG. 6 while substantially maintaining the top dead center position T.

As shown in FIG. 4, the actuator 213 includes the lug plate 251, a movable body 213*a*, and a control pressure chamber 213*b*. The lug plate 251 forms the link mechanism 207 as described above and also functions as a fixed body according to the present invention.

The movable body 213*a* is fitted to the drive shaft 203 and is movable along the rotation axis O while sliding on the drive shaft 203. The movable body 213*a* has a cylindrical shape that is coaxial with the drive shaft 203 and has a diameter smaller than that of the thrust bearing 255. The movable body 213*a* is formed such that the diameter increases from the rear end toward the front end.

An operation portion 234 is formed integrally with the rear end of the movable body 213*a*. The operation portion 234 extends vertically from the rotation axis O toward the top dead center position T of the swash plate 205 and is in point contact with the projection 205*g*. This allows the movable body 213*a* to rotate integrally with the lug plate 251 and the swash plate 205.

The movable body 213*a* can be fitted to the lug plate 251 by inserting the front end of the movable body 213*a* in the cylinder chamber 251*a*. In a state in which the front end of the movable body 213*a* is inserted to the innermost position in the cylinder chamber 251*a*, the front end of the movable body 213*a* is located at a position that corresponds to the interior of the thrust bearing 255 in the cylinder chamber 251*a*.

The control pressure chamber 213*b* is defined by the front end of the movable body 213*a*, the cylinder chamber 251*a*, and the drive shaft 203. The control pressure chamber 213*b* is partitioned from the swash plate chamber 225 and the pressure regulation chamber 32 by the movable body 213, the lug plate 251, and the drive shaft 203.

The drive shaft 203 has an axial passage 203*a* and a radial passage 203*b*. The axial passage 203*a* extends from the rear end of the drive shaft 203 toward the front end along the rotation axis O. The radial passage 203*b* extends in a radial direction from the front end of the axial passage 203*a* and opens in the outer circumferential surface of the drive shaft 203. The rear end of the axial passage 203*a* is open in the pressure regulation chamber 32. The radial passage 203*b* is open in the control pressure chamber 213*b*. The axial passage 203*a* and the radial passage 203*b* connect the pressure regulation chamber 32 to the control pressure chamber 213*b*.

The drive shaft 203 is connected to a non-illustrated pulley or an electromagnetic clutch by a thread portion 203*e* formed at the distal end like the compressor according to the first embodiment.

The pistons 209 are respectively accommodated in the corresponding cylinder bores 221*a* and are capable of reciprocating in the corresponding cylinder bores 221*a*. Each piston 209 and the valve forming plate 223 define a compression chamber 257 in the corresponding cylinder bore 221*a*.

The pistons 209 respectively have engaging portions 209*a*. Each engaging portion 209*a* accommodates the hemispherical shoes 211*a*, 211*b*. The shoes 211*a*, 211*b* convert rotation of the swash plate 205 into reciprocation of the pistons 209. The shoes 211*a*, 211*b* also correspond to a conversion mechanism according to the present invention. The pistons 209 thus reciprocate in the corresponding cylinder bores 221*a* by the stroke corresponding to the inclination angle of the swash plate 205.

As shown in FIG. 5, the control mechanism 16 includes a low-pressure passage 16*a*, a high-pressure passage 16*b*, a control valve 16*c*, an orifice 16*d*, the axial passage 203*a*, and the radial passage 203*b*. The axial passage 203*a* and the radial passage 203*b* correspond to a variable pressure passage according to the present invention. Furthermore, the low-pressure passage 16*a*, the high-pressure passage 16*b*, the axial passage 203*a*, and the radial passage 203*b* form a control passage according to the present invention.

The low-pressure passage 16*a* is connected to the pressure regulation chamber 32 and the suction chamber 34. The low-pressure passage 16*a*, the axial passage 203*a*, and the radial passage 203*b* connect the control pressure chamber 213*b*, the pressure regulation chamber 32, and the suction chamber 34 to one another. The high-pressure passage 16*b* is connected to the pressure regulation chamber 32 and the discharge chamber 36. The discharge refrigerant in the discharge chamber 36 flows through the high-pressure passage 16*b*. The high-pressure passage 16*b*, the axial passage 203*a*, and the radial passage 203*b* connect the control pressure chamber 213*b*, the pressure regulation chamber 32, and the discharge chamber 36. The high-pressure passage 16*b* also has the orifice 16*d*.

In this manner, the suction chamber 34 and the discharge chamber 36, the pressure regulation chamber 32, and the control pressure chamber 213*b* are connected so that the pressure regulation chamber 32 is located between the control pressure chamber 213*b* and both the suction chamber 34 and the discharge chamber 36. Furthermore, the pressure regulation chamber 32 is a space with a cross-sectional area that is greater than the passage cross-sectional area of any of the low-pressure passage 16*a*, the high-pressure passage 16*b*, the axial passage 203*a*, and the radial passage 203*b*.

The control valve 16*c* is arranged in the low-pressure passage 16*a*. The control valve 16*c* is capable of adjusting the opening degree of the low-pressure passage 16*a* in accordance with the pressure in the suction chamber 34.

In this compressor, a pipe coupled to the evaporator is coupled to the suction port 250 shown in FIG. 4, and a pipe coupled to the condenser is coupled to the discharge port. Like the compressor of the first embodiment, the compressor of the present embodiment is included in the refrigeration circuit of the air conditioner for a vehicle together with the evaporator, the expansion valve, and the condenser.

In the compressor having the above-described configuration, the drive shaft 203 rotates to rotate the swash plate 205, thus reciprocating each piston 209 in the corresponding cylinder bore 221*a*. This varies the volume of each compression chamber 257 in accordance with the piston stroke. Thus, the suction refrigerant that has been drawn from the evaporator into the swash plate chamber 225 through the suction port 250 flows through the suction passage 239 and the suction chamber 34 and is compressed in the compression chambers 257. The suction refrigerant that is compressed in the compression chambers 257 is discharged to the discharge chamber 36 as discharge refrigerant and is discharged to the condenser through the discharge port.

Like the compressor of the first embodiment, the compressor of the present embodiment is capable of performing displacement control by changing the inclination angle of the swash plate 205 to selectively increase and decrease the stroke of the pistons 209.

More specifically, when the control valve 16*c* of the control mechanism 16 shown in FIG. 5 increases the opening degree of the low-pressure passage 16*a*, the pressure in the pressure regulation chamber 32 and thus the pressure in the control pressure chamber 213*b* become substantially equal to the pressure in the suction chamber 34. The piston compression force that acts on the swash plate 205 causes the movable body 213*a* of the actuator 213 to slide in the cylinder chamber 251*a* along the rotation axis O from the swash plate 205 toward the lug plate 251 as shown in FIG. 4. This reduces the volume of the control pressure chamber 213*b*. The front end of the movable body 213*a* thus enters the cylinder chamber 251*a*.

Simultaneously, the swash plate arms 205*e* slide along the sliding surface 251*b* to separate away from the rotation axis O. Thus, the bottom dead center portion of the swash plate 205 pivots clockwise while substantially maintaining the top dead center position T. The inclination angle of the swash plate 205 relative to the rotation axis O of the drive shaft 203 is thus increased. This increases the stroke of the pistons 209 and thus increases the displacement of the compressor per rotation of the drive shaft 203. The inclination angle of the swash plate 205 shown in FIG. 4 corresponds to the maximum inclination angle in the compressor.

Figure 6:
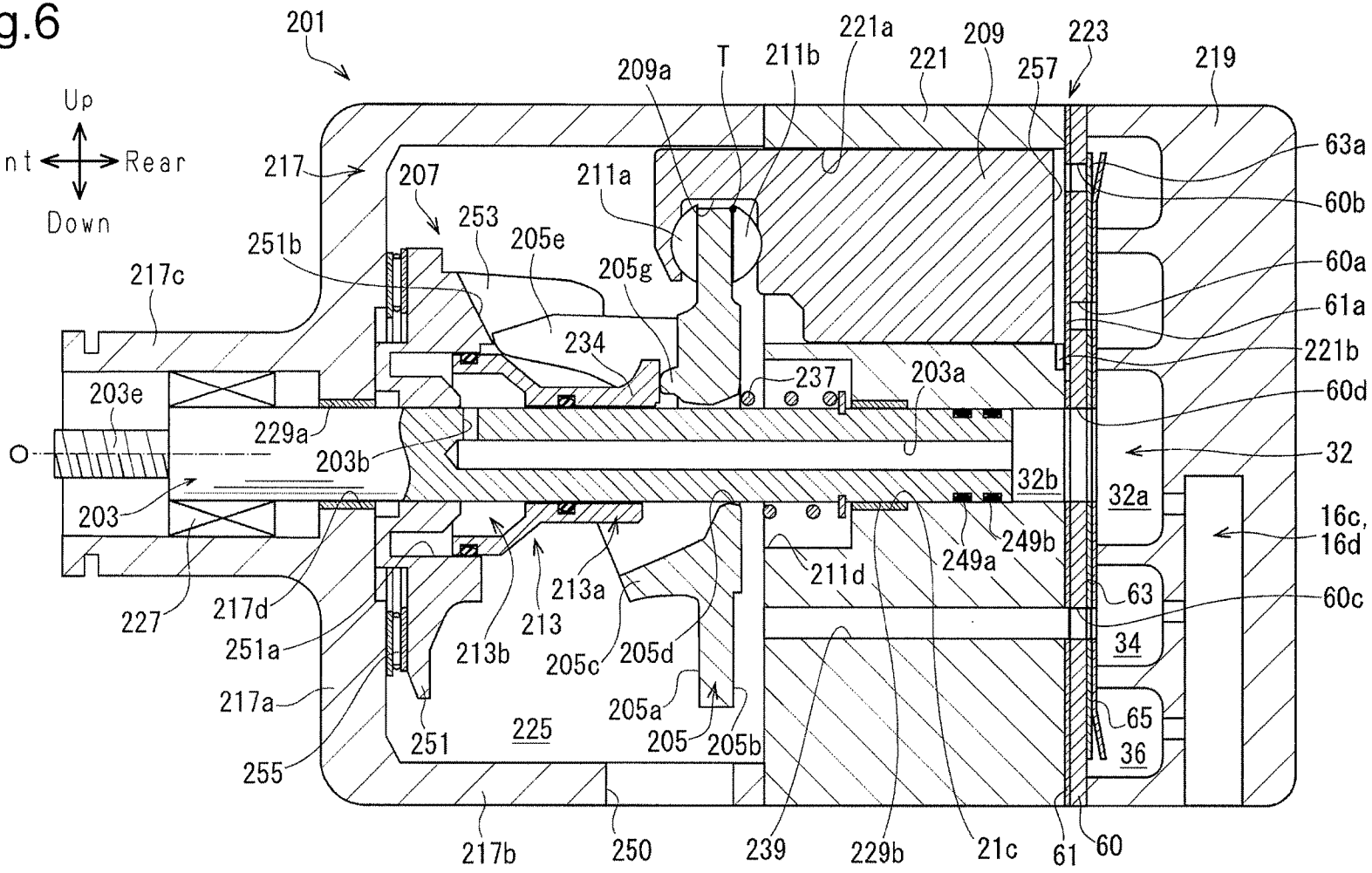
FIG. 6 is a cross-sectional view of the compressor according to the second embodiment at the minimum displacement.

When the control valve 16*c* shown in FIG. 5 reduces the opening degree of the low-pressure passage 16*a*, the pressure in the pressure regulation chamber 32 is increased, and the pressure in the control pressure chamber 213*b* is increased. As shown in FIG. 6, since the movable body 213*a* slides in the cylinder chamber 251*a* along the rotation axis O toward the swash plate 205 while separating away from the lug plate 251, the volume of the control pressure chamber 213*b* of the actuator 213 is increased.

This causes the operation portion 234 to push the projection 205*g* toward the rear of the swash plate chamber 225. The swash plate arms 205*e* thus slide along the sliding surface 251*b* to approach the rotation axis O. This causes the bottom dead center portion of the swash plate 205 to pivot counterclockwise while substantially maintaining the top dead center position T. The inclination angle of the swash plate 5 relative to the rotation axis O of the drive shaft 203 is thus decreased. This reduces the stroke of the pistons 209 and the displacement of the compressor per rotation of the drive shaft 203. The inclination angle of the swash plate 205 shown in FIG. 6 corresponds to the minimum inclination angle in the compressor.

Like the compressor of the first embodiment, the pressure regulation chamber 32 of the compressor of the present embodiment functions as a muffler that reduces the pulsation of the discharge refrigerant and the suction refrigerant. In this compressor, the volume of the pressure regulation chamber 32 is greater than the volume of the control pressure chamber 213*b* when the displacement is maximized and until the displacement is reduced to a certain amount from the maximum.

In the compressor of the present embodiment, the pressure regulation chamber 32 is located between the control pressure chamber 213*b* and both the suction chamber 34 and the discharge chamber 36. Thus, when the discharge refrigerant in the discharge chamber 36 flows into the control pressure chamber 213*b* via the pressure regulation chamber 32, the pulsation is reduced in the pressure regulation chamber 32 before the discharge refrigerant flows into the control pressure chamber 213*b*. The pressure regulation chamber 32 also reduces the pulsation of the suction refrigerant in the suction chamber 34. Since the actuator 213 is unlikely to be influenced by the pulsation of the discharge refrigerant and the suction refrigerant when changing the inclination angle of the swash plate 205, the compressor is allowed to stabilize the inclination angle of the swash plate 205.

The first pressure regulation chamber 32*a* and the second pressure regulation chamber 32*b* form the pressure regulation chamber 32, and the first pressure regulation chamber 32*a* has a diameter greater than those of the first and second shaft holes 217*d*, 221*c*. Furthermore, the pressure regulation chamber 32 is a space with a cross-sectional area that is greater than the passage cross-sectional area of any of the low-pressure passage 16*a*, the high-pressure passage 16*b*, the axial passage 203*a*, and the radial passage 203*b*. Due to these reasons, the pressure regulation chamber 32 also has a sufficient volume. Thus, the compressor is also capable of sufficiently reducing the pulsation of the discharge refrigerant and the suction refrigerant with the pressure regulation chamber 32.

In particular, as the inclination angle of the swash plate 205 is increased, the volume of the control pressure chamber 213*b* is reduced. When the inclination angle of the swash plate 205 is maximized, that is, when the displacement is maximized, the volume of the control pressure chamber 213*b* is minimized. Thus, unlike the compressor of the first embodiment, the actuator 213 is apt to be significantly affected by the pulsation of the discharge refrigerant and the suction refrigerant when the displacement of the compressor of the present embodiment is changed to be reduced from the maximum state. However, since the pressure regulation chamber 32 also reduces the pulsation of the discharge refrigerant as described above, even when starting to change the displacement from the maximum displacement state, the inclination angle of the swash plate 205 is stable. The other operations of the compressor are the same as the corresponding operations of the compressor of the first embodiment.

Although only the first and second embodiments of the present invention have been described so far, the present invention is not limited to the first and second embodiments, but may be modified as necessary without departing from the scope of the invention.

For example, regarding the control mechanism 15 of the compressor according to the first embodiment, the control valve 15*c* may be provided in the high-pressure passage 15*b*, and the orifice 15*d* may be provided in the low-pressure passage 15*a*. In this case, the control valve 15*c* is capable of adjusting the opening degree of the high-pressure passage 15*b*. This allows the high-pressure in the second discharge chamber 29*b* to promptly increase the pressure in the control pressure chamber 13*c* and to promptly reduce the displacement. The same applies to the control mechanism 16 of the compressor according to the second embodiment.

Also, in the compressor of the second embodiment, the swash plate arms 205*e* and the lug arms 253 may be pivotally coupled with, for example, a coupling pin to couple the lug plate 251 to the swash plate 205.

Furthermore, in the compressor of the first embodiment, the pressure regulation chamber 31 is formed only in the rear housing member 19. However, the pressure regulation chamber 31 may be formed in the rear housing member 19 and the second cylinder block 23, or may be formed in only the second cylinder block 23.

Additionally, in the compressor of the second embodiment, the pressure regulation chamber 32 may be formed with only the first pressure regulation chamber 32*a* in the rear housing member 219, or may be formed with only the second pressure regulation chamber 32*b* in the cylinder block 221.

The invention claimed is:

1. A swash plate type variable displacement compressor comprising:

a housing in which a suction chamber, a discharge chamber, a swash plate chamber, and a cylinder bore are formed;

a drive shaft that is rotationally supported by the housing;

a swash plate that is rotational in the swash plate chamber by rotation of the drive shaft;

a link mechanism arranged between the drive shaft and the swash plate, wherein the link mechanism allows change of an inclination angle of the swash plate with respect to a direction perpendicular to a rotation axis of the drive shaft;

a piston reciprocally received in the cylinder bore;

a conversion mechanism that causes the piston to reciprocate in the cylinder bore by a stroke corresponding to the inclination angle of the swash plate through rotation of the swash plate;

an actuator that changes the inclination angle of the swash plate;

a control mechanism that controls the actuator, wherein the housing has a pressure regulation chamber, the actuator includes a fixed body that is located in the swash plate chamber and fixed to the drive shaft, a movable body that is provided on the drive shaft and is capable of changing the inclination angle of the swash plate by moving along the rotation axis of the drive shaft, a control pressure chamber defined by the fixed body and the movable body, and the fixed body being arranged within the movable body and the movable body being slidable relative to the fixed body, wherein a volume of the control pressure chamber changes in response to varying refrigerant within the control pressure chamber, thereby moving the movable body, the control mechanism includes a control passage that connects together the discharge chamber, the pressure regulation chamber, and the control pressure chamber, and a control valve that adjusts an opening degree of the control passage to change the pressure in the control pressure chamber to allow the movable body to move, wherein the refrigerant flows from the discharge chamber into the control pressure chamber via the pressure regulation chamber, and the pressure regulation chamber functions as a muffler that reduces pulsation of the refrigerant, wherein a width of the pressure regulation chamber in a direction perpendicular to the rotation axis of the drive shaft is larger than a diameter of the drive shaft; and at least one valve plate separating an interior of the housing into a first region provided at a first planar side of the valve plate and a second region provided at a second planar side of the valve plate, wherein the pressure regulation chamber and the discharge chamber are both provided within the first region on the first planar side of the valve plate.

2. The swash plate type variable displacement compressor according to claim 1, wherein the pressure regulation chamber is a space that has a cross-sectional area greater than a cross-sectional area of the control passage.

3. The swash plate type variable displacement compressor according to claim 1, wherein the pressure regulation chamber is located at a rear end of the drive shaft, and at least part of the control passage is formed in the drive shaft.

4. The swash plate type variable displacement compressor according to claim 1, wherein the housing includes a cylinder block that has the cylinder bore and a shaft hole in which the drive shaft is inserted and a cover that includes the suction chamber and the discharge chamber, and the pressure regulation chamber is formed in at least one of the cylinder block and the cover.

5. The swash plate type variable displacement compressor according to claim 4, wherein the pressure regulation chamber is formed radially inward of the suction chamber and the discharge chamber in the cover, wherein the cover is placed over the shaft hole.

6. The swash plate type variable displacement compressor according to claim 1, wherein at least one of the suction chamber and the swash plate chamber is a low-pressure chamber, and the control passage includes a high-pressure passage that connects the discharge chamber to the pressure regulation chamber, a low-pressure passage that connects the low-pressure chamber to the pressure regulation chamber, and a variable pressure passage that is formed in the drive shaft and connects the pressure regulation chamber to the control pressure chamber.

7. The swash plate type variable displacement compressor according to claim 6, wherein the control valve is provided in the low-pressure passage, and the high-pressure passage includes a restrictor.

8. The swash plate type variable displacement compressor according to claim 1, wherein the control pressure chamber is provided within the second region on the second side of the valve plate.

* * * * *